US006991232B1

(12) United States Patent
Yufa

(10) Patent No.: US 6,991,232 B1
(45) Date of Patent: Jan. 31, 2006

(54) PORTABLE BOARD MULTI-GAME SET

(75) Inventor: Ann Rachel Yufa, Colton, CA (US)

(73) Assignees: Aleksandr L. Yufa, Colton, CA (US); Yelena V. Yufa, Colton, CA (US)

( * ) Notice: Subject to any disclaimer, the term of this patent is extended or adjusted under 35 U.S.C. 154(b) by 0 days.

(21) Appl. No.: 10/846,752

(22) Filed: May 14, 2004

(51) Int. Cl.
*A63F 3/00* (2006.01)

(52) U.S. Cl. ..... 273/239; 273/285

(58) Field of Classification Search ..... 273/239, 273/282.1, 283, 284, 285, 287
See application file for complete search history.

(56) References Cited

U.S. PATENT DOCUMENTS

| | | | | |
|---|---|---|---|---|
| 636,663 | A * | 11/1899 | Harrison | 273/284 |
| 1,893,732 | A * | 1/1933 | Cutler | 273/283 |
| 3,023,006 | A * | 2/1962 | Kovacs | 273/282.1 |
| 3,633,913 | A * | 1/1972 | Solimene | 273/248 |
| 3,851,885 | A * | 12/1974 | Pepkowski et al. | 273/287 |
| 3,930,652 | A | 1/1976 | Lapolice | |
| 4,371,168 | A | 2/1983 | Dupuis | |
| 5,197,742 | A | 3/1993 | Bendit | |
| 5,244,212 | A | 9/1993 | Bendit | |
| 5,413,352 | A | 5/1995 | Persidsky et al. | |
| 5,490,675 | A | 2/1996 | Persidsky et al. | |
| 5,871,212 | A | 2/1999 | Lee | |

OTHER PUBLICATIONS

Chess/checker/backgammon set (2 pages).*
3-in-1 full size folding games set (2 pages).*

* cited by examiner

*Primary Examiner*—Vishu K. Mendiratta

(57) ABSTRACT

This invention provides the portable (pocket size) board multi-game set for playing chess, checker or backgammon games. An improved portable board multi-game set includes the set of chess and checker/backgammon pieces each including the piece opening, inclosure and director, a game board comprising two foldable half-boards coupled to each other by the hinges, chess/checker field layer, a backgammon field layer, and the apertures located on the side of the board intended for chess/checker games and providing the prevention of the piece's misplacement off the center of the squares on the chess/checker game field by passage of the piece's director into aperture. The portable board game set also comprises a compartment for storage of the pieces.

15 Claims, 15 Drawing Sheets

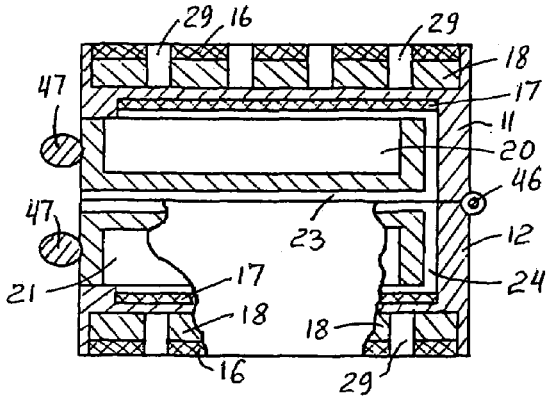
Fig. 6b
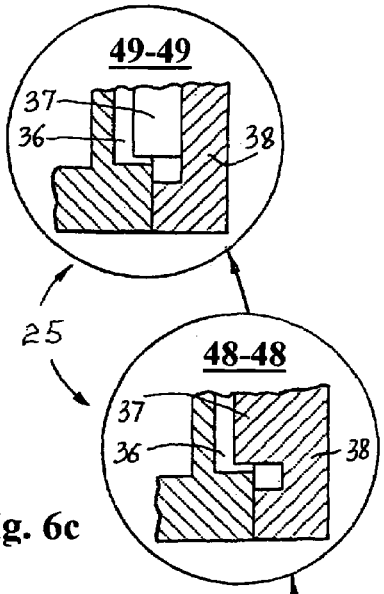
Fig. 6c
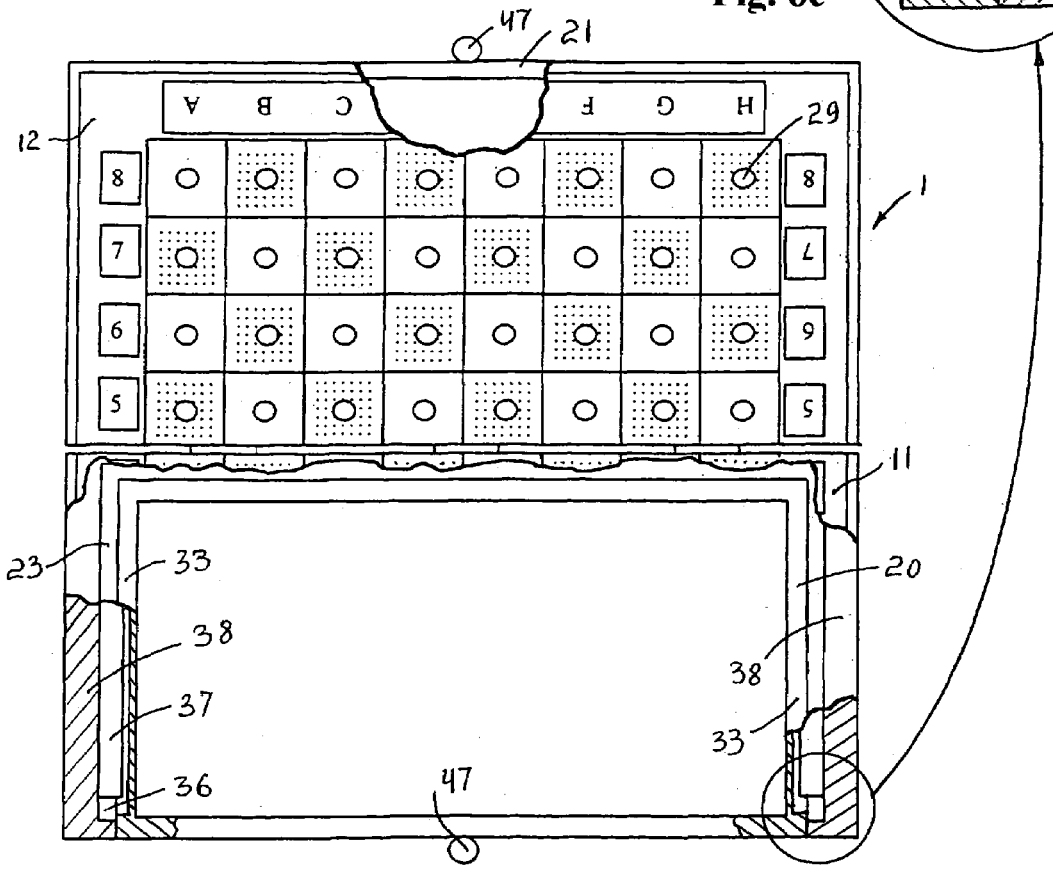

PORTABLE BOARD MULTI-GAME SET

FIELD OF THE INVENTION

The present invention relates to the portable games, and more specifically to a portable (pocket-size) chess/checkers/backgammon set (apparatus).

BACKGROUND OF THE INVENTION

Chess, checker and backgammon are the games played using two sets of pieces on the boards. Chess and checker use a square form board with 64 spaces (smaller squares) of alternating colors, typically light and dark (mostly white and black). The backgammon game also uses the square form board and the game field usually with the dark color pattern (e.g. black) and, for example, white and red triangular form sections for pieces also known as stones (some players call them as draughts too). Typically, chess game include two sets of chessmen (also known as pawns and pieces), and the checker game (also known as draughtmen) and backgammon game use two sets of pieces (draughts). One set of the mentioned two sets has a light color and the another set has a dark color (usually white and black, but any other combination of colors may be used as well). The chessmen (pawns and pieces) and draughts will be conditionally referred to as pieces in this application hereinafter. The mentioned above two sets will be referred to as a set of pieces, and the set of pieces includes white piece set and black piece set. The white set of pieces includes only white pieces, and black set of pieces includes only black pieces. Also, hereinafter in this application a multi-game set will be considered to include the set of pieces and a game board.

Some chess/checker players record the moves made during a chess/checker game (match). Therefore, the chess/checker game board has the file and rank identification for each square. The files and ranks are mostly labeled in the different manner. White player always start the game (moves first).

A board may have the files and ranks marked (labeled) on only two contiguous sides, but mostly the board has the files and ranks marked (labeled) on all four sides. As disclosed in the U.S. Pat. No. 5,197,742, the black piece player reads the letters upside-down. If the numbers are not sideways, the problem of the player with the black pieces is compounded. One of the difficulties with this is that the board must be turned around before the next game with its customary color reversal.

The chessboard by U.S. Pat. No. 5,871,212 disclosing a sectional chessboard which includes a number of sections corresponding to blocks of a chessboard wherein each section of the chessboard has protrusions and grooves around all sides thereof to be respectively engaged with grooves and protrusions of other sections so that all adjoining sides of each section is jointed together for playing chess as a complete chessboard.

Such chess game set can not be conveniently used as a portable pocket-size game for car, bus, train or airplane tourists. Also, the mentioned set does not prevent the possible occasional disposition pieces on the board during a non-accurate or negligent player's manner to position piece near or even upon the borders of a square on the board, and/or at the moment of the unexpected tour-bus maneuver during the game.

Another U.S. Pat. No. 3,930,652 describes portable lawn playing checker apparatus including a board having a first and a second face; with a plurality of rectangles inscribed upon the first face and a first storage compartment and a second storage compartment attached to the second face of the rectangular base board on opposite ends of the base board for storing a plurality of movable rings, which are used as checkers. The board comprises the first and second holding compartments. The first holding means and a second holding means are attached to the first face of the board on opposite ends of the board. The first and second holding means are used for holding the movable rings (pieces) when playing the game to be played on the mentioned checker apparatus. The checker apparatus also comprises the special means for moving the movable rings from square to square. An example of the means for moving the movable rings is a device having a reaching member and a hook on one end of the reaching member.

This apparatus does not provide and suggests the multi-game possibility (for example, possibility also to play chess and/or backgammon), requires to use an additional special instrument such as piece mover, and also does not prevent the possible occasional disposition pieces on the board during a non-accurate or negligent player's manner to position piece near or even upon the borders of a square on the board.

As was mentioned above, the another inconvenience inherent when some players have a non-accurate or negligent manner to position piece near or even upon the borders of a square occasionally disposition opponent's piece on the board (one player knows where the piece is /should be or was/, but the another player /opponent/ can get thrown off by its off-center placement).

It is known, that the opponent sometimes has to say, "J'adoube" (adjust) before he or she may touch your ill-placed piece and then place it in the center of the square. Doing so, however, deprives the opponent of time allocated him or her by previous agreement. Another tactic some players use is floating a piece to a position just above a square but not contacting the square. This is called hovering. The general rule is touch a piece, move that piece, touch a square, leave it there. Players like to hover because it allows them to see ahead an additional move. Sometimes a player will hover interminably over a square which represents the worst move possible. This can cause the opponent to anticipate one course of action. Then the player will move with lightning speed and occupy a square which represents the best move possible. This is a technique that causes disappointment, consternation, confusion and palpitations in that order.

The inconvenience of a sudden displacement (roaming, sliding, etc.) of the pieces on the board, for example, at the moment of the unexpected tour-bus maneuver during the game, may cause the arguments about the positions before the displacement and sometimes search for missing (e.g. fell down) pieces.

To avoid these deficiencies, the magnetic effect for the board and pieces is used in some known portable sets.

The U.S. Pat. Nos. 5,490,675; 5,413,352; 5,244,212; 5,197,742 and 4,371,168 use the magnetic attraction between board and pieces. For example, the chess game devices by U.S. Pat. Nos. 5,490,675 and 5,413,352 include a steel sheet attached to the board, and the pieces have a magnets installed in the bottom part of the pieces.

Such devices do not provide and suggests the multi-game possibility (for example, possibility also to play checker and/or backgammon games), and also does not prevent the possible occasional disposition pieces on the board, for example, at the moment of the unexpected tour-bus maneuver during the game, that may cause the player's arguments about the positions before the displacement and sometimes search for missing pieces. Additionally, such set games often suffer from inadequate magnetic attraction/repulsion between adjacent pieces.

The chess game sets by U.S. Pat. Nos. 5,244,212; 5,197,742 provide each square of the board and each piece with the magnet appropriately installed in the each board's square and in the bottom of each piece.

These game sets do not provide and suggests the multi-game possibility (for example, possibility to play checker and/or backgammon games), and also does not prevent the possible occasional disposition pieces on the board, for example, at the moment of the unexpected tour-bus maneuver during the game, that may cause the player's arguments about the positions before the displacement and sometimes search for the fell down pieces. Also, such set games often suffer from inadequate magnetic attraction/repulsion between adjacent pieces.

Another U.S. Pat. No. 4,371,168 describes the pocket-size chess set, which comprises two slidable para-magnetic checkerboard halves and the flat pieces provided with a magnetic element on the back and bottom surfaces of each piece. Thus, each piece (chessman) may be placed either horizontally for storage or vertically for play on the checkerboard. Each square has a recessed circular portion located at the center of the square, and their margins are also recessed for the placing a piece thereon. Each piece is relatively thin and is provided with a magnetic element having a back surface and a narrow bottom surface projecting slightly below its lower end. In both positions (vertical and horizontal), the magnetic element is in contact with the recessed portion, so that each piece is properly centered on its square. When a piece is laid horizontally on a square, it lies flat because the back surface of its magnetic element extends into the recess.

This chess game set does not provide and suggests the multi-game possibility (for example, possibility to play checker and/or backgammon games), and the recesses on the board create some difficulties to use regular pieces of another set with such board having recesses (for example, the pieces of the another set without extended magnetic portion at the bottom of the pieces and having incompatible diameter of the piece's bottom portion with the diameter of the recesses /e.g. slightly bigger than the diameter of the recess/).

While this device fulfill it respective, particular objectives and requirements, the mentioned above patents do not disclose, teach and/or suggest the portable (pocket-size) multi-game set preventing occasional/accidental piece disposition on the board (for example, at the moment of the unexpected tour-bus maneuver during the game, that may cause the player's arguments about the positions before the displacement and sometimes search for missing /e.g. fell down pieces/) and inadequate magnetic attraction/repulsion between adjacent pieces on the board.

Those skilled in the art will readily observe that numerous modifications and advantages of the improved portable (pocket-size) multi-game set may be made while retaining the teachings of the invention.

Thus, the known prior art do not provide the comfortable and convenient portable (pocket-size) multi-game set (apparatus) and in theses respects, an improved portable (pocket-size) multi-game set according to the present invention substantially departs from the devices of the prior art.

OBJECT AND ADVANTAGES OF THE INVENTION

Accordingly, several objects and advantages of the present invention are to provide an improved portable board game set.

It is another object of the invention to increase convenience of the improved portable pocket-size board game.

It is further object of the invention to provide the multi-game portable (pocket-size) set.

It is still another object of the invention to increase convenience and comfortability of the improved portable board game set, providing the prevention of the possible occasional disposition pieces on the board during a non-accurate or negligent player's manner to position piece near or even upon the borders of a square on the board.

It is still further object of the invention to prevent the possible occasional disposition pieces on the board at the moment of the unexpected movements, for example, such as a tour-bus maneuver during the game.

It is also further object of the invention to prevent the possible inadequate magnetic attraction/repulsion between adjacent pieces on the game board.

DESCRIPTION OF THE DRAWING

In order that the invention and the manner in which it is to be performed may be more clearly understood, embodiments thereof will be described by way of example with reference to the attached drawings, of which:

FIGS. 6*a*–6*e* are the simplified representations of the game board with the storage (drawers) for pieces.

SUMMARY OF THE INVENTION

In view of the foregoing disadvantages inherent in the known prior art, the present invention provides a new convenient portable (pocket-size) multi-game apparatus. As such, the general purpose of the present invention, which will be described hereinafter in greater details, is to provide a new portable (pocket-size) multi-game set, which has many of the advantages of the portable game apparatus mentioned heretofore and many novel features that result in the pocket-size multi game with secure pieces possible misplacement on the board, which is not anticipated, rendered obvious, suggested or even implied by any of prior art portable board game devices, either alone or in any combination thereof.

To attain this, the present invention generally comprises the portable (pocket-size) multi-game apparatus (set) for playing chess, checker or backgammon games. An improved portable (pocket-size) multi-game set includes a game board comprising two half-boards coupled to each other by a folding means, the chess/checker and backgammon field layers, and the chess and checker/backgammon pieces each including the piece opening, inclosure and director, which is insertable into the apertures located in the game board and providing the central positioning of the pieces on the appropriate square of the chess/checker game field, thereby preventing misplacement of the piece.

DESCRIPTION OF THE PREFERRED EMBODIMENTS

With reference now to the drawings, and particularly to FIGS. 1*a*–8*b* thereof, a new portable (pocket-size) multi-game apparatus (set) for playing chess, checker and/or backgammon games embodying the principles and concepts of the present invention.

Figure 1A:
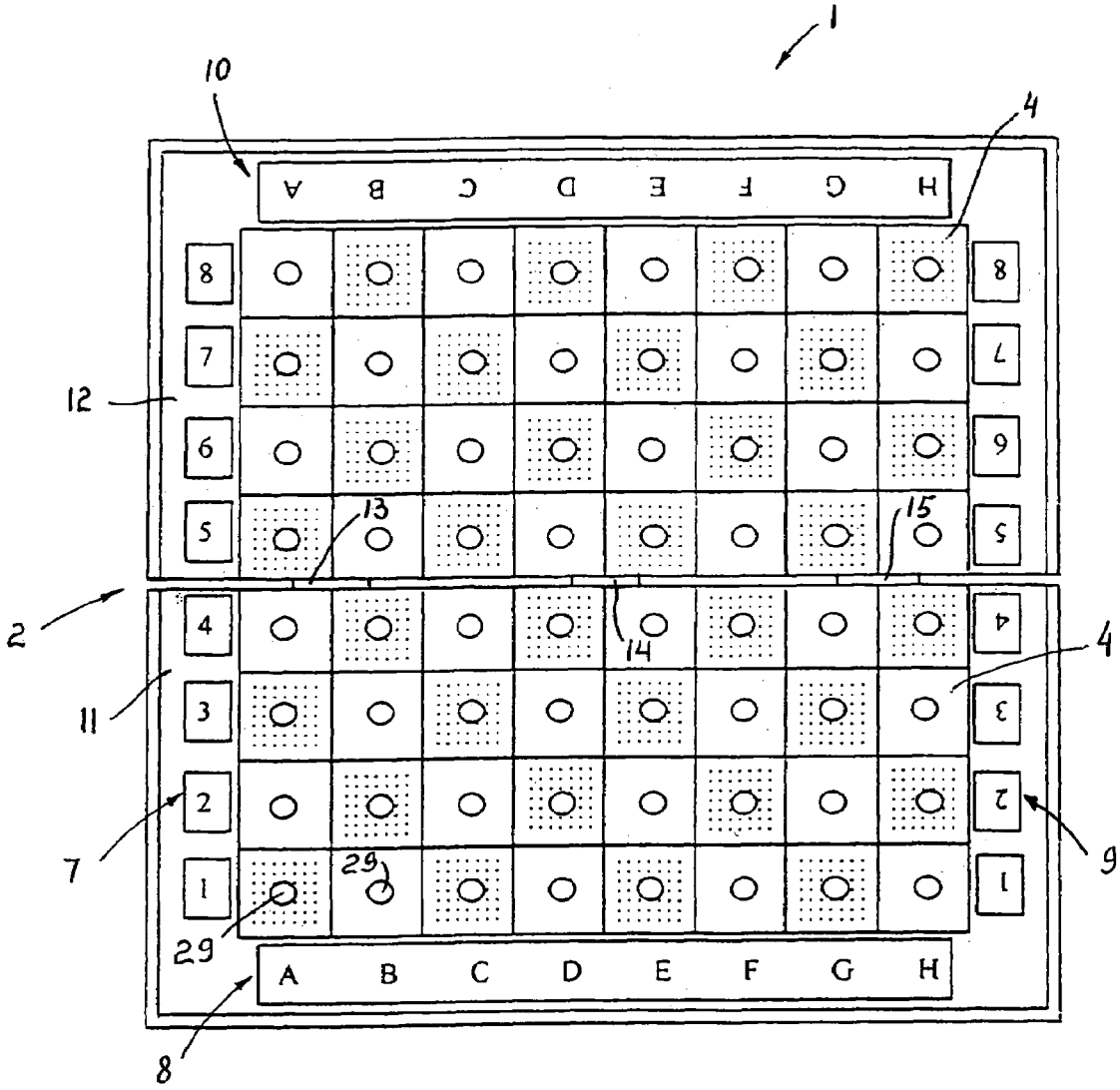
FIGS. 1*a*–1*c* are the simplified representations of the unfolded (ready to play) game board of the improved portable (pocket-size) multi-game apparatus for chess/checker games.
Figure 1B:
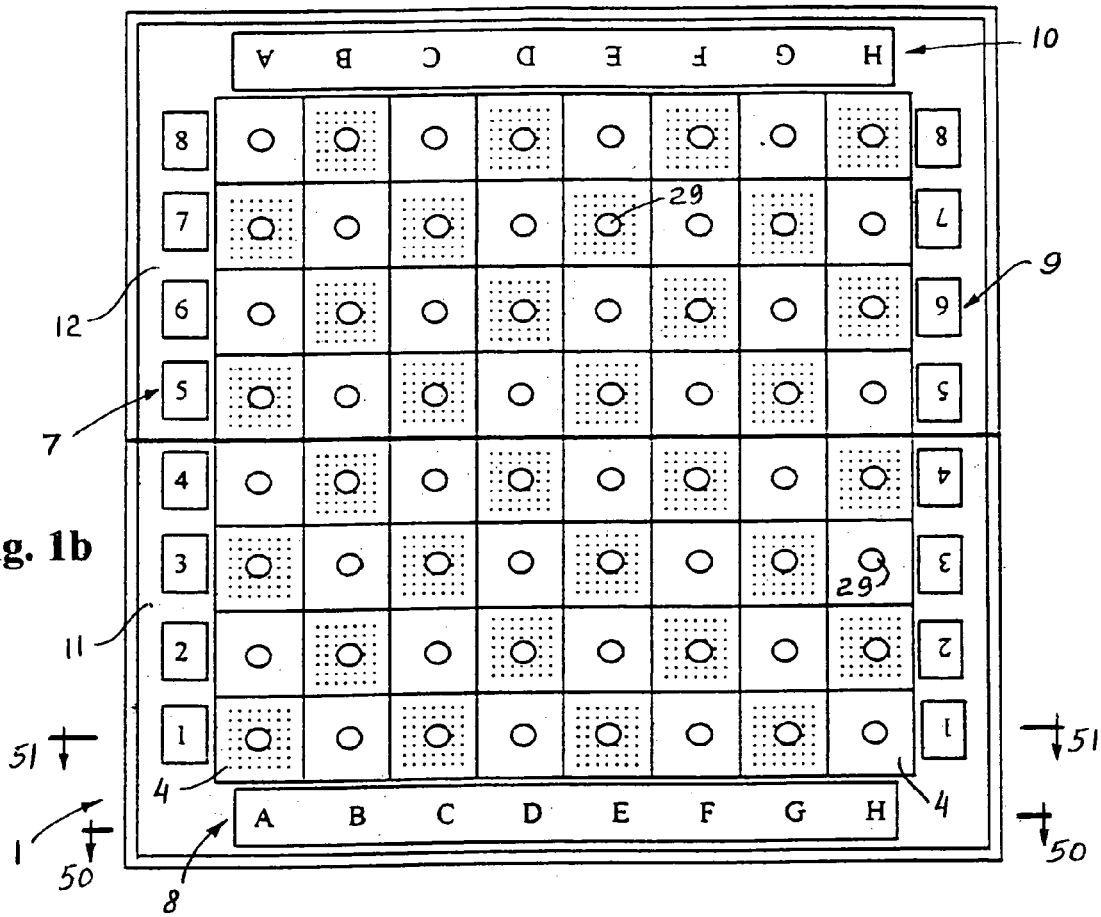
Figure 1C:
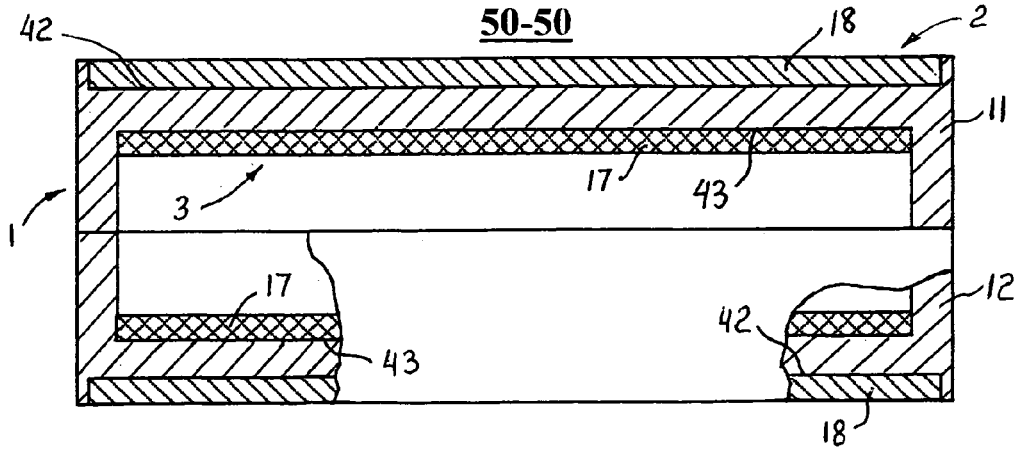

Referring to FIG. 1*a*, an improved pocket-size multi-game apparatus comprises a game board 1, including a chess/checker game field 2 located on the outer side 42 (see FIG. 1*c*) of the game board 1 and a backgammon game field 3 (shown in FIGS. 2*a*, 2*b*) located on the opposite side (inner side 43) of the game board 1 as shown in FIG. 1*c*. The chess/checker field 2 comprises the squares 4 for the chess pieces 5 or checker pieces 6 (also used for backgammon game) shown in FIGS. 3*a*–3*d*. The chess/checker field 2 of the board 1 includes the file and rank identifications (horizontal and vertical respectively) for each square 4 of the chess/checker game field 2. For the white piece player the left vertical side of the board (file identification) has the first numerical symbol field 7 with numbers "1" through "8" from the bottom of the board to it's top and the horizontal side of the board (rank identification) has the first alphabetical symbol field 8 with letters "A" through "H" from the left of the board to the right (so, the player playing the white pieces has square Al at his or her lower left-hand corner of the board). Appropriately for the black piece player convenience the left vertical side of the board has the second numerical symbol field 9 with numbers "8" through "1" from the bottom of the board to it's top and the horizontal side of the board has the second alphabetical symbol field 10 with letters "H" through "A" from the left of the board to the right (so, the player playing the black pieces has square "H8" at his or her lower left-hand corner of the board). The backgammon field 3 mostly have triangular areas for pieces 6.

Figure 2A:
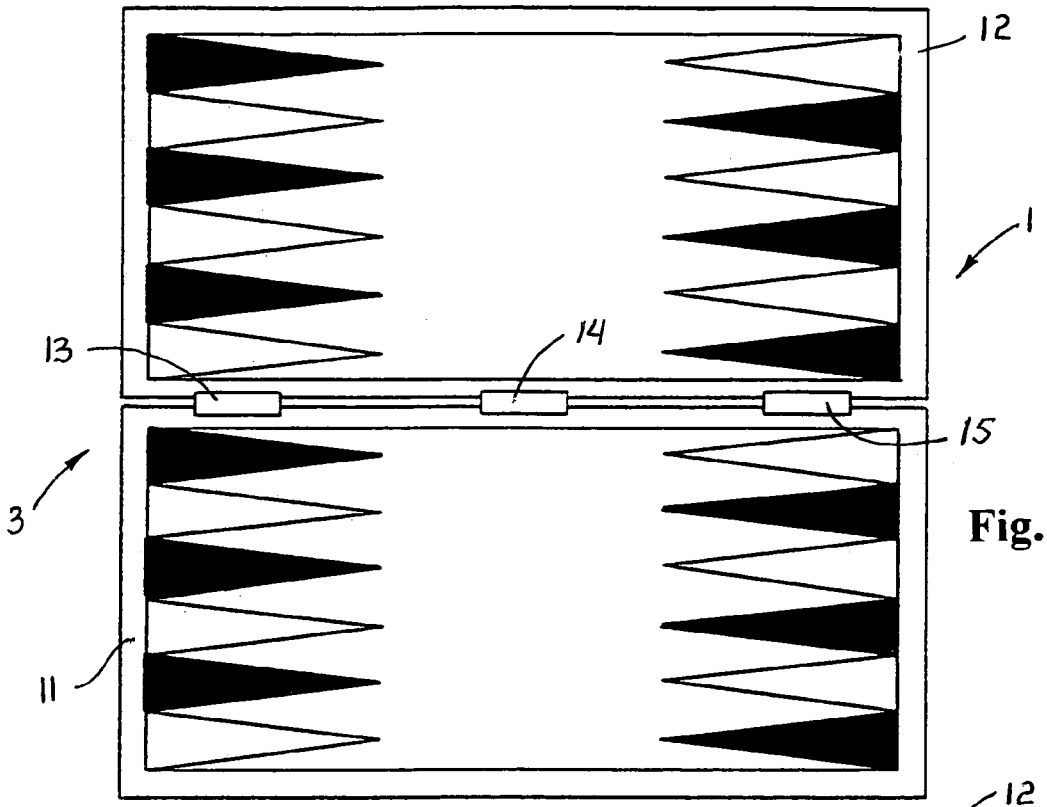
FIGS. 2*a*, 2*b* are the simplified representations of the unfolded game board of the improved portable (pocket-size) multi-game apparatus for backgammon.
Figure 2B:
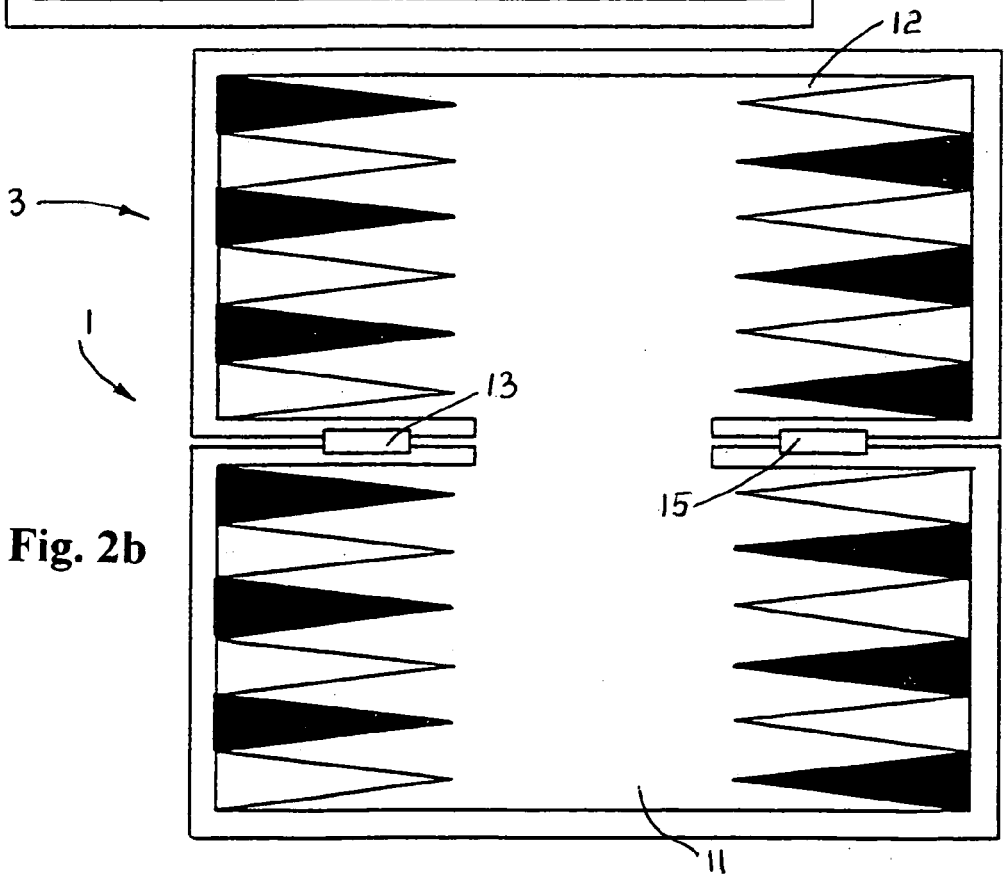
Figure 4A:
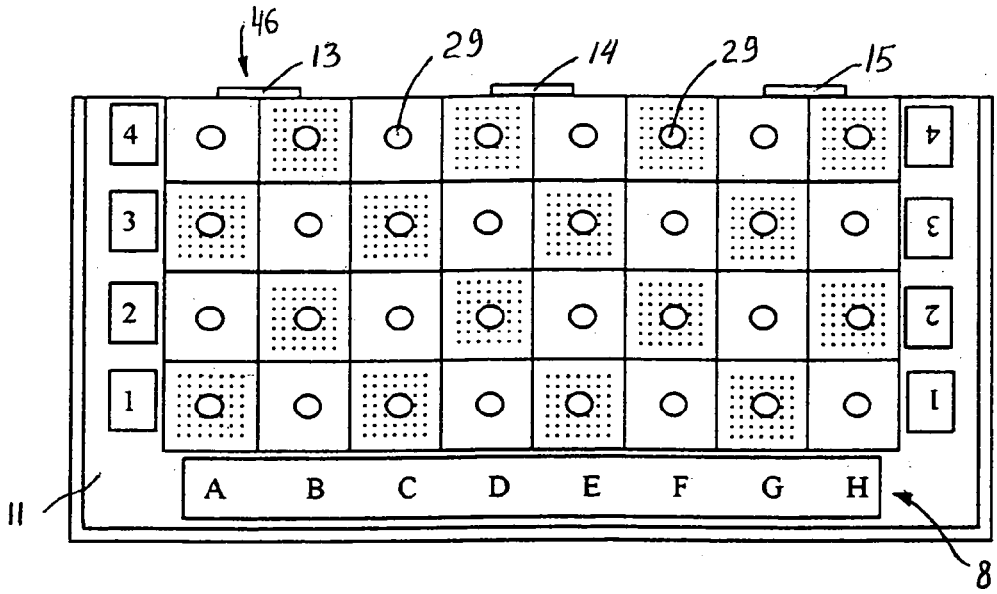
FIGS. 4*a*–4*c* are the simplified representations of the front and side views of the folded (closed) game board.
Figure 4B:
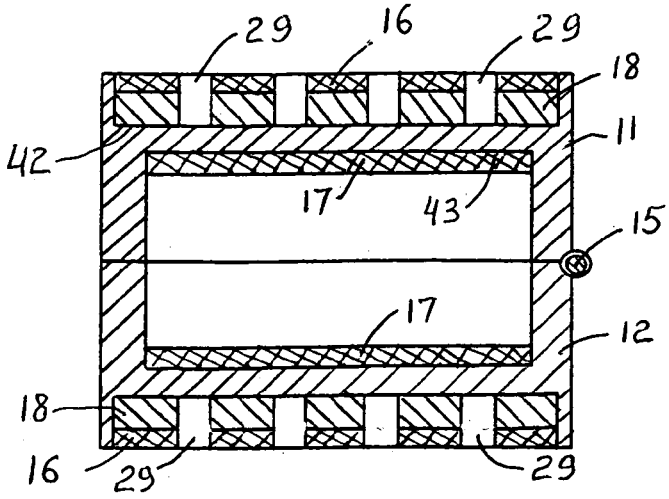

The game board 1 is a foldable board forming a box in the closed (initial) position. The game board 1 comprises two halves: a first half-board 11 and a second half-board 12, as shown in FIGS. 1*a*–2*b*, 4*a*–7*f*. The halves 11 and 12 coupled to each other, for example, by folding means 46 (in FIGS. 1*a*, 2*a*, 4*a* are conditionally shown the folding means 46 consisting of three hinging means: a first hinging means 13, a second hinging means 14 and a third hinging means 15, in FIG. 2*b* are conditionally shown two hinging means: a first hinging means 13, and a third hinging means 15, but any types and configuration of folding/hinging means, for instance, singular long hinge /not shown/, two side-hinges /not shown/ and the others can be used (the reliable solid /molded/ foldable material can be used as the hinging means too, etc.). The hinging means provides folding of the rectangular game board in half and can be installed in such manner that there are, for example, no gap between two halves of the unfolded (open and ready to play) board, as it is shown in FIGS. 1*b*, 7*d*, or the small (narrow) gap between two halves of the unfolded board can be in presence, as it is shown, for example, in FIGS. 1*a*, 7*c*. Also, the foldable material (e.g. such as a reliable foldable plastic, etc) can be used too instead of the hinges.

Figure 4C:
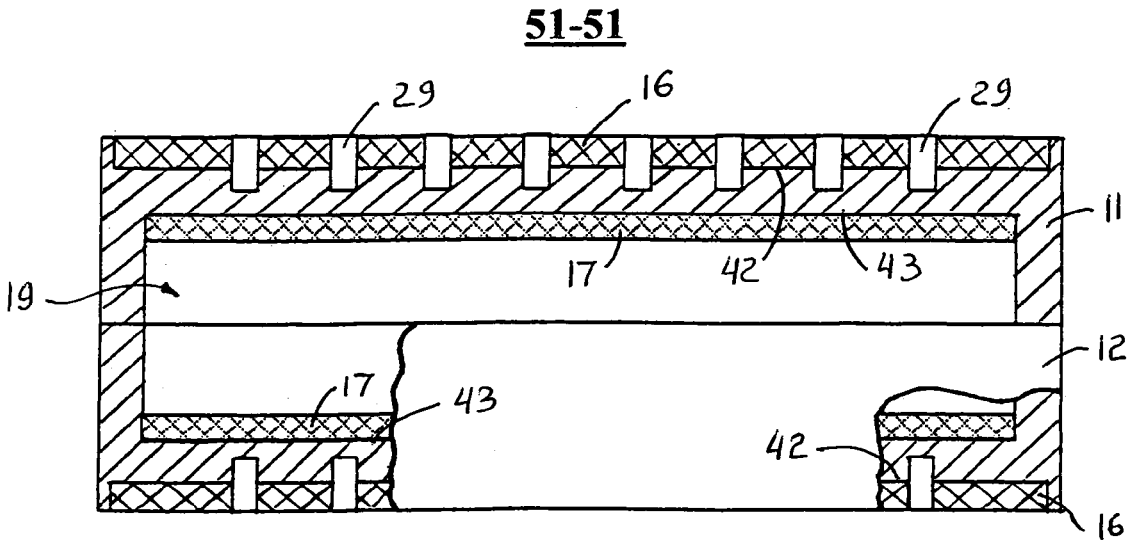
Figure 5A:
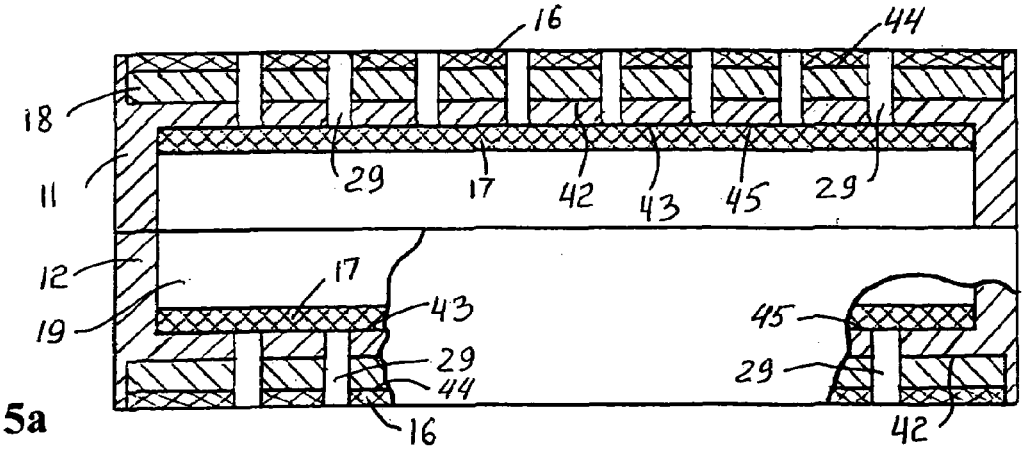
FIGS. 5*a*–5*d* are the simplified representations of the game board with the apertures for pieces central positioning on the squares of the board.
Figure 5B:
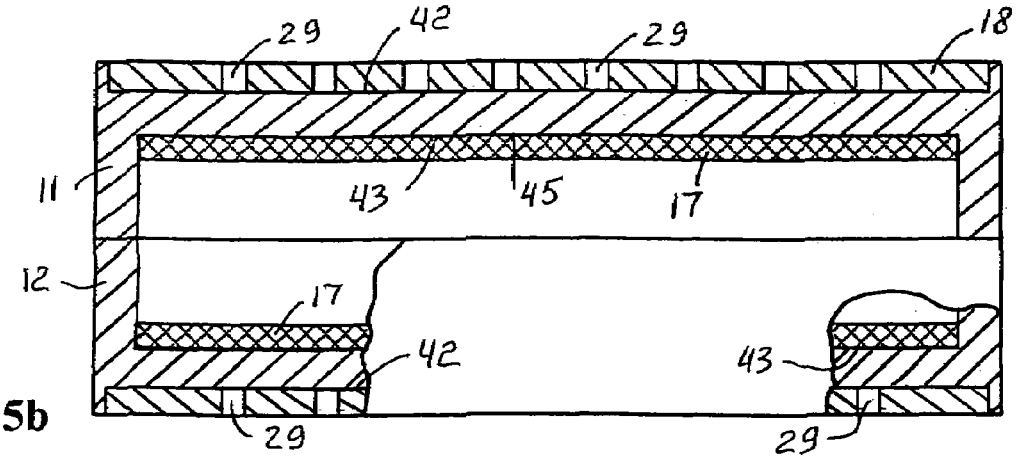
Figure 5C:
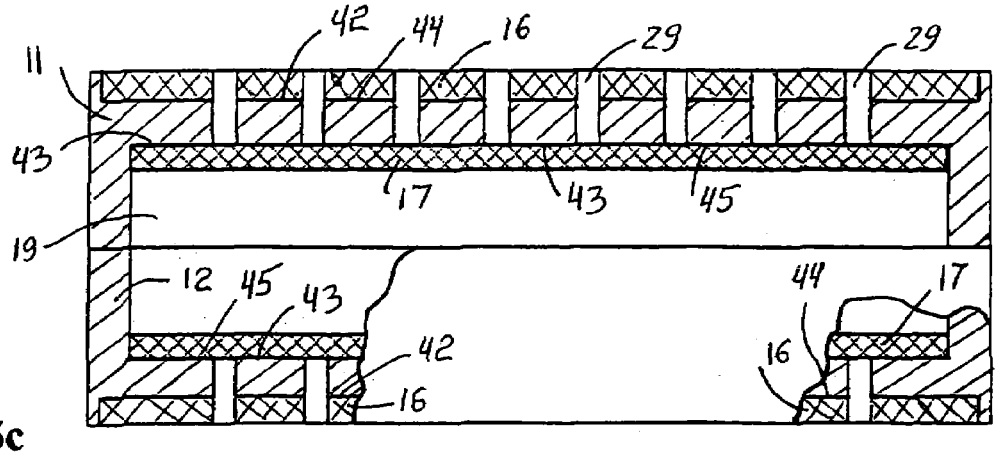
Figure 5D:
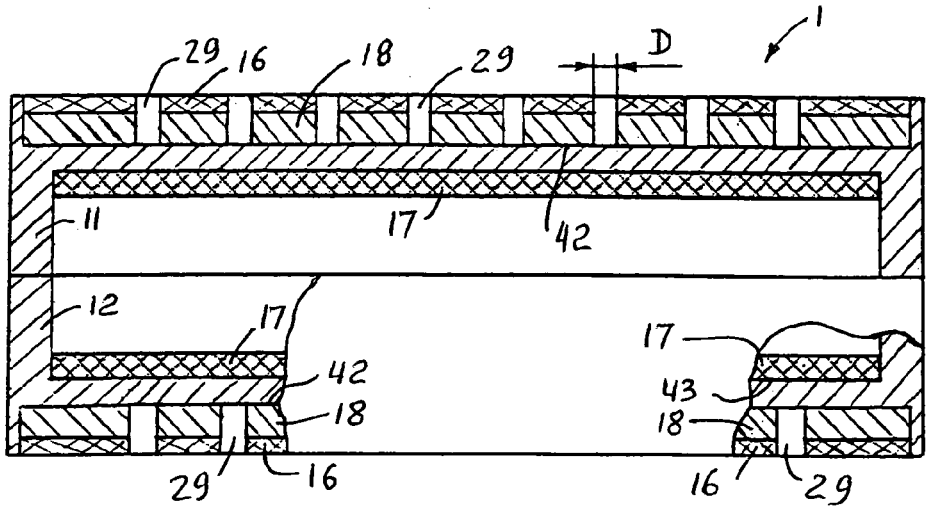

The game board 1 also can include the chess/checker field layer 16, the backgammon field layer 17 and the main layer 18 (see FIGS. 4*c*, 5*c*). The magnetic effect (magnetic attraction) for the board and pieces is used in this improved pocket-size multi-game apparatus (set). The main layer 18 can be of magnetic material (e.g. such as paramagnetic material) or of non-magnetic metallic material. If the field layer 16 or 17 or both of them are of magnetic material, the game board 1 might not need (might not include) the main layer 18 (see FIGS. 4*c*, 5*c*). The layers 16 and 18 are of two appropriate halves. The layer 16 can be located on the appropriate halves of the main layer 18, which are attached to the outer side 42 of the first half-board 11 and second half-board 12 respectively, if the main layer 18 is used. The backgammon field layer 17 is also of two appropriate halves located on the inner side 43 of the first half-board 11 and second half-board 12 respectively. If the main layer 18 is attached to the inner side 43 of the game board 1 (not shown), then the backgammon field layer 17 is attached to the main layer 18, and the layer 16 is attached to the outer side 42 of the first half-board 11 and second half-board 12 respectively. All layers are fixedly attached to the game board 1. If the main layer 18 includes the pre-printed chess/checker game field or the backgammon game field, the appropriate layer (chess/checker layer 16 or backgammon layer 17) is not needed, as illustrated, for example in FIGS. 1*c*, 5*b* (the pre-print of the chess/checker game field is not shown). The inner sides 44 and 45 respectively of the field layers 16 and/or 17 can be self-adhesive. The side of the main layer 18, which is intended to be attached to the game board 1, can be self-adhesive too. The layers 18 and 16 can be installed in the not deep recess provided in the outer side 42 of the half-boards 11 and 12, thereby creating the game field margin and peripheral rim, as shown, for example, in FIGS. 1*c*, 4*b*, 4*c*, 5*a*–5*c*.

Figure 6A:
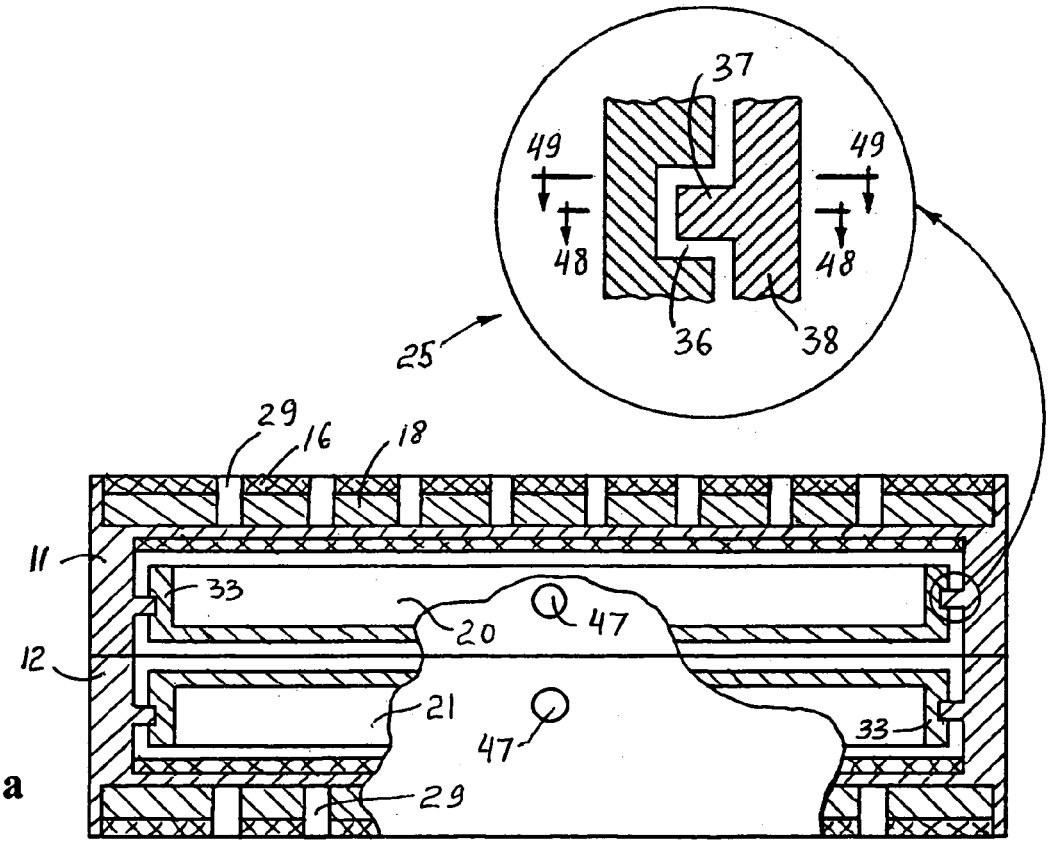
Figure 6D:
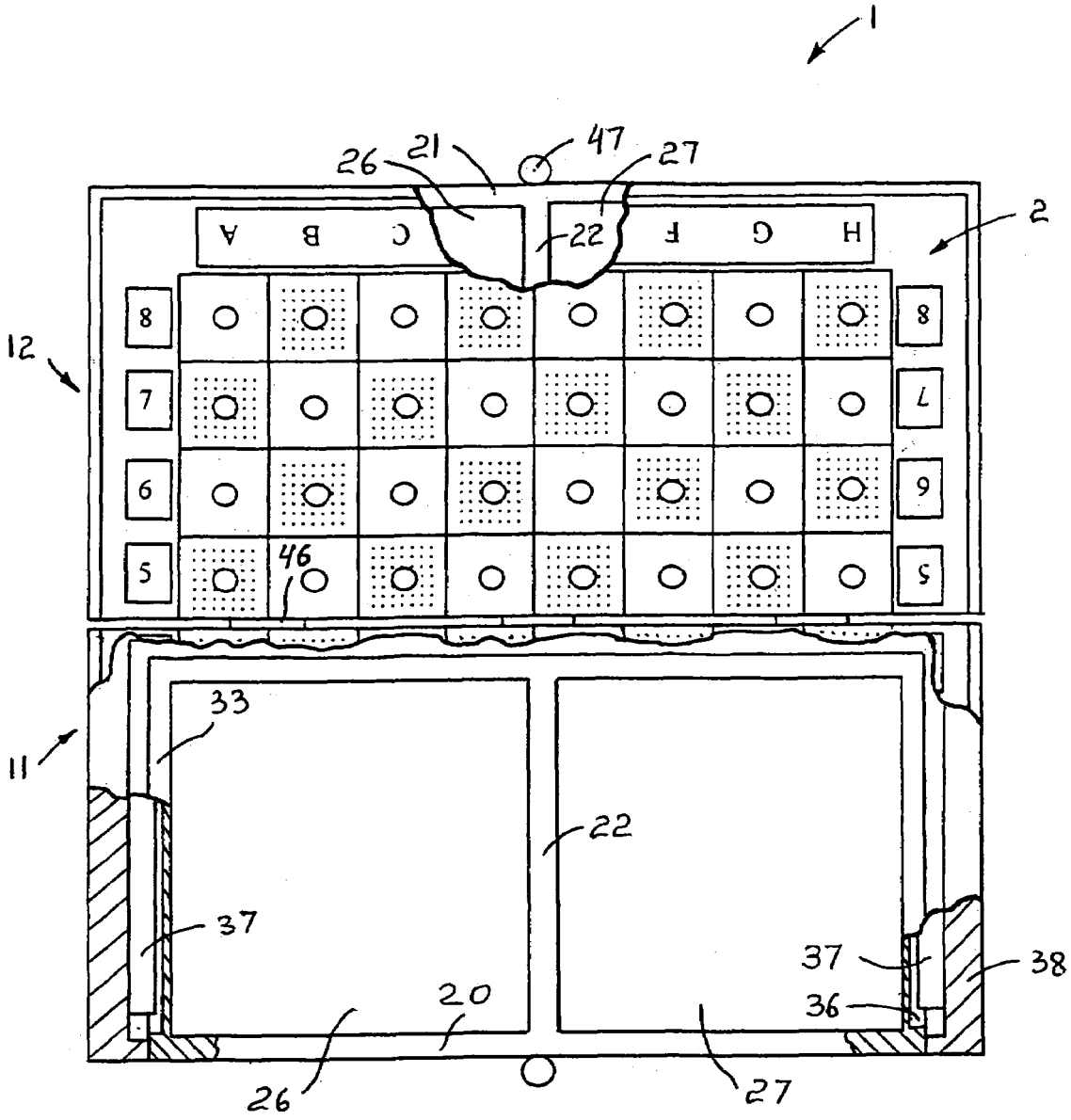
Figure 6E:
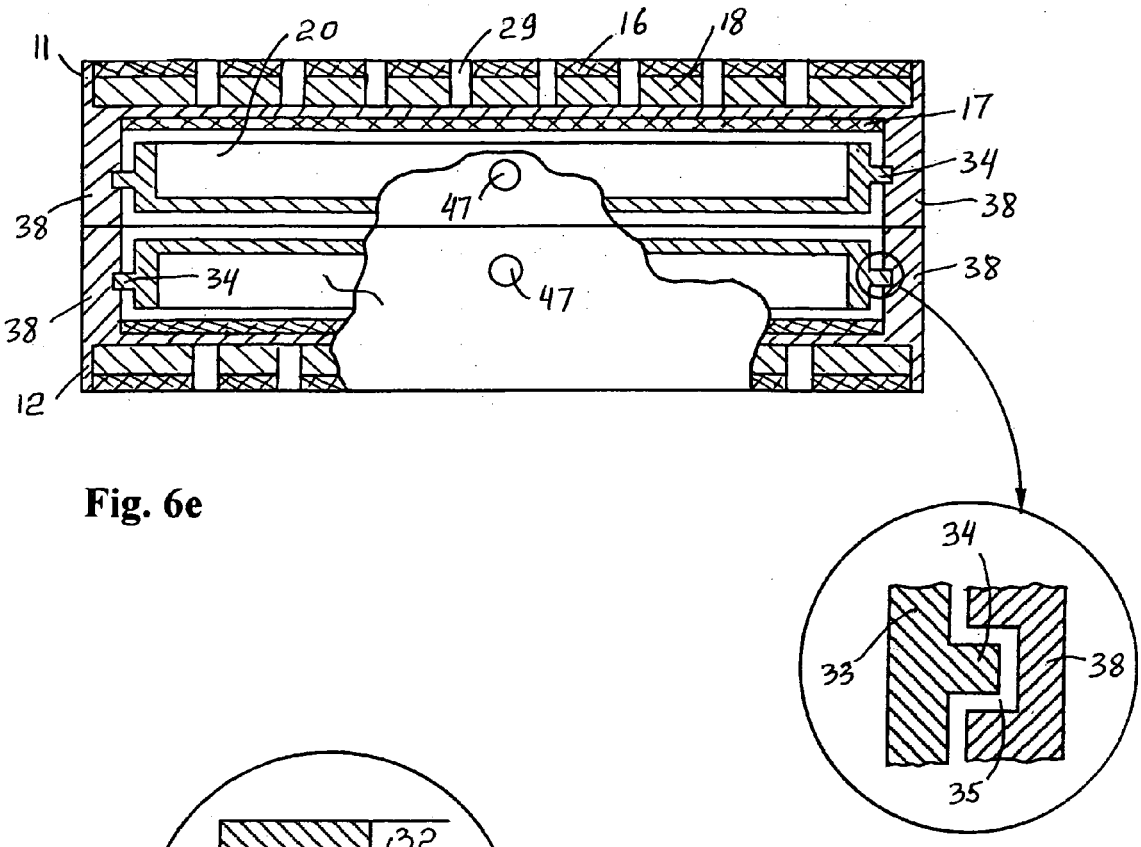
Figure 7A:
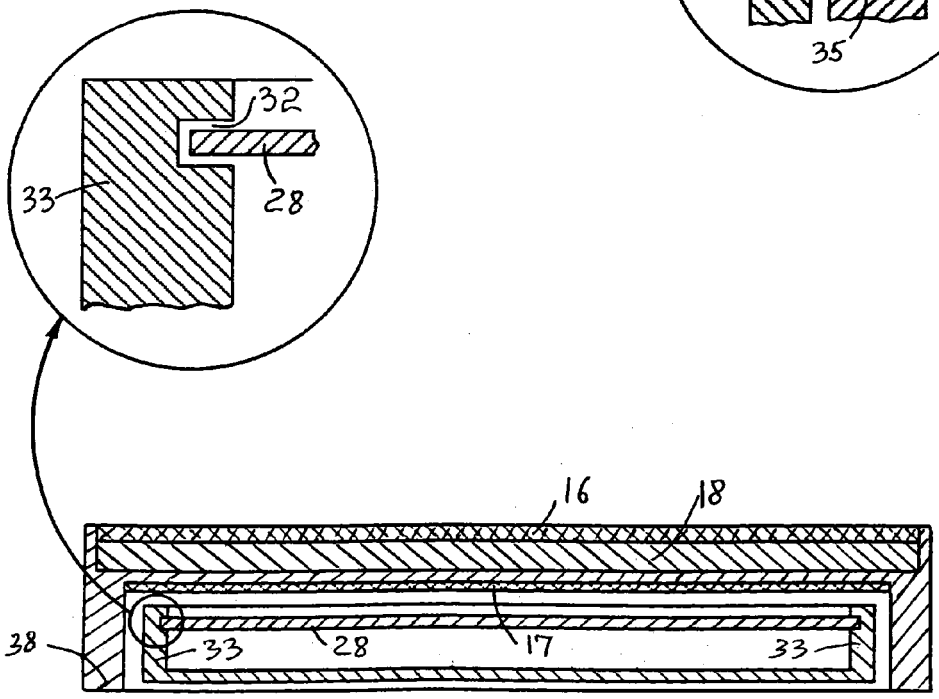
FIGS. 7*a*–7*f* are the simplified representations of the front and side views of the unfolded (ready for game) game board with the drawers for pieces storage.
Figure 7B:
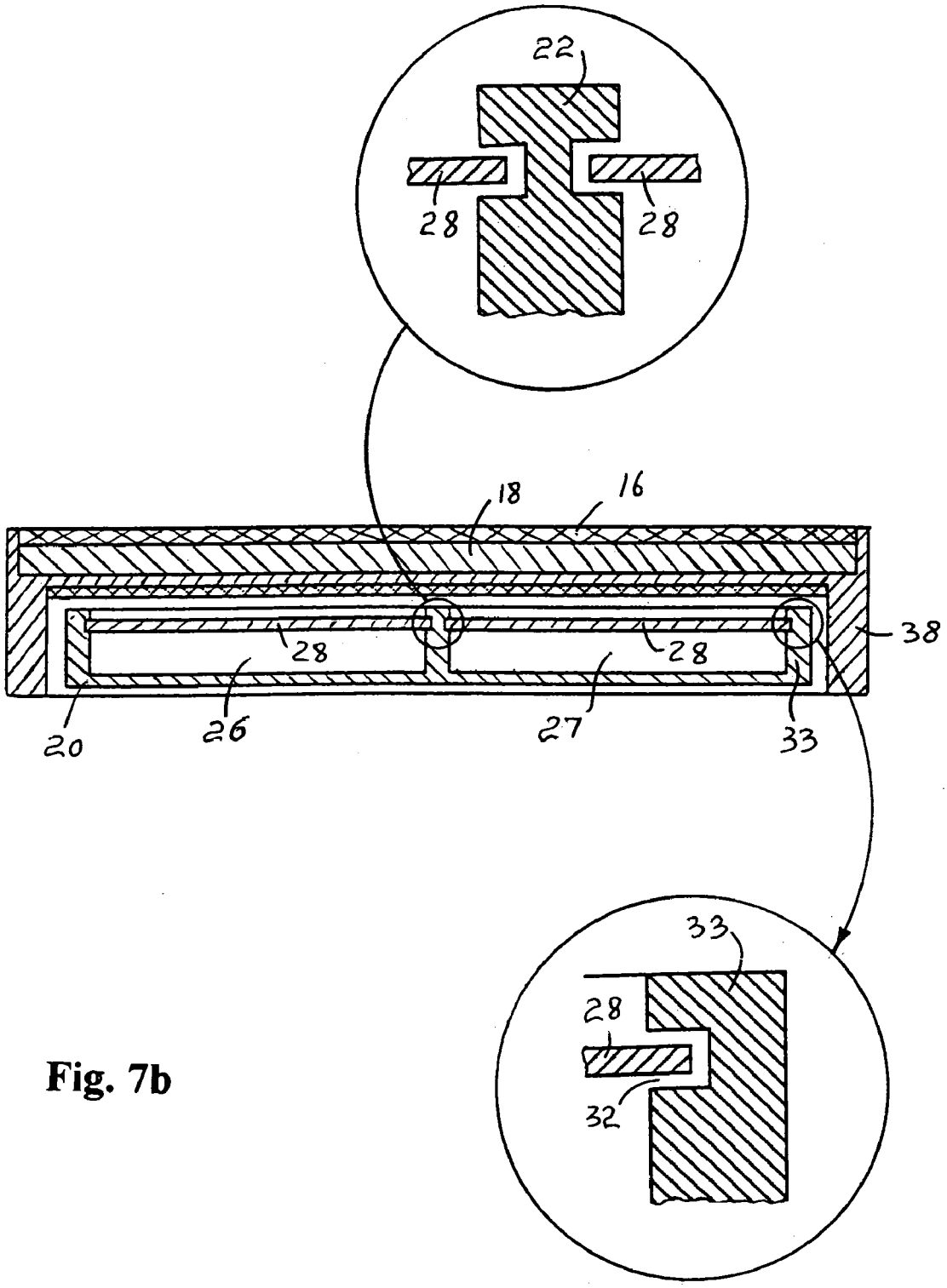
Figure 7C:
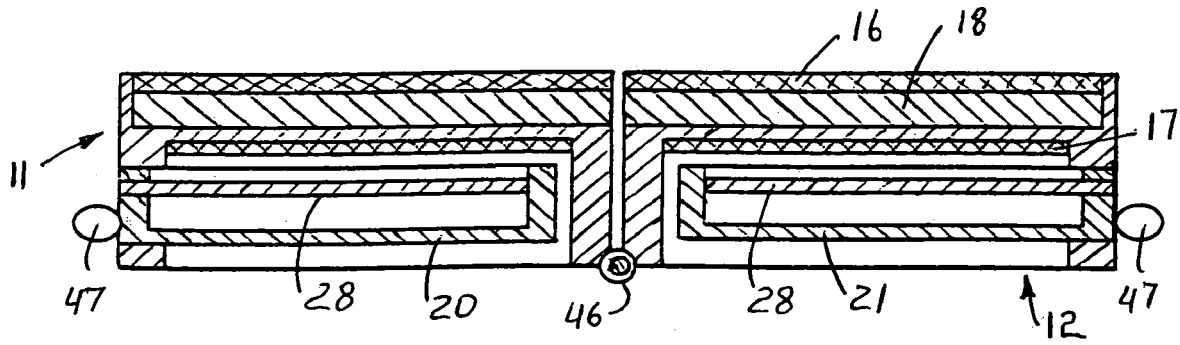
Figure 7D:
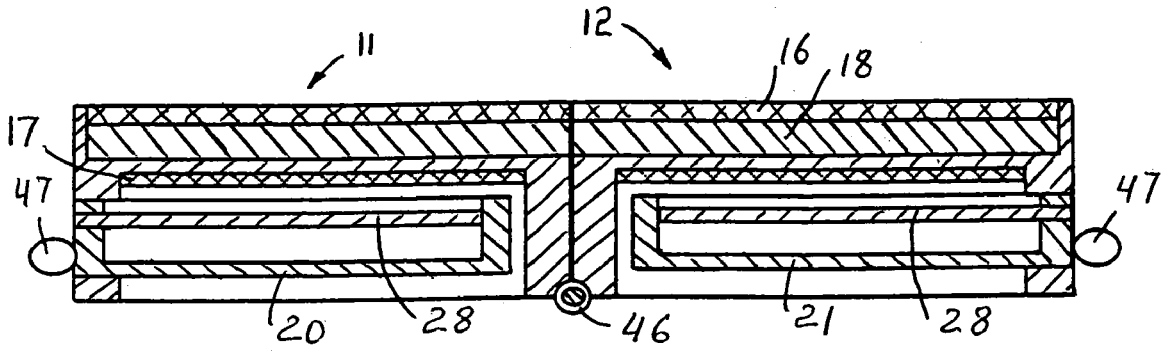
Figure 7E:
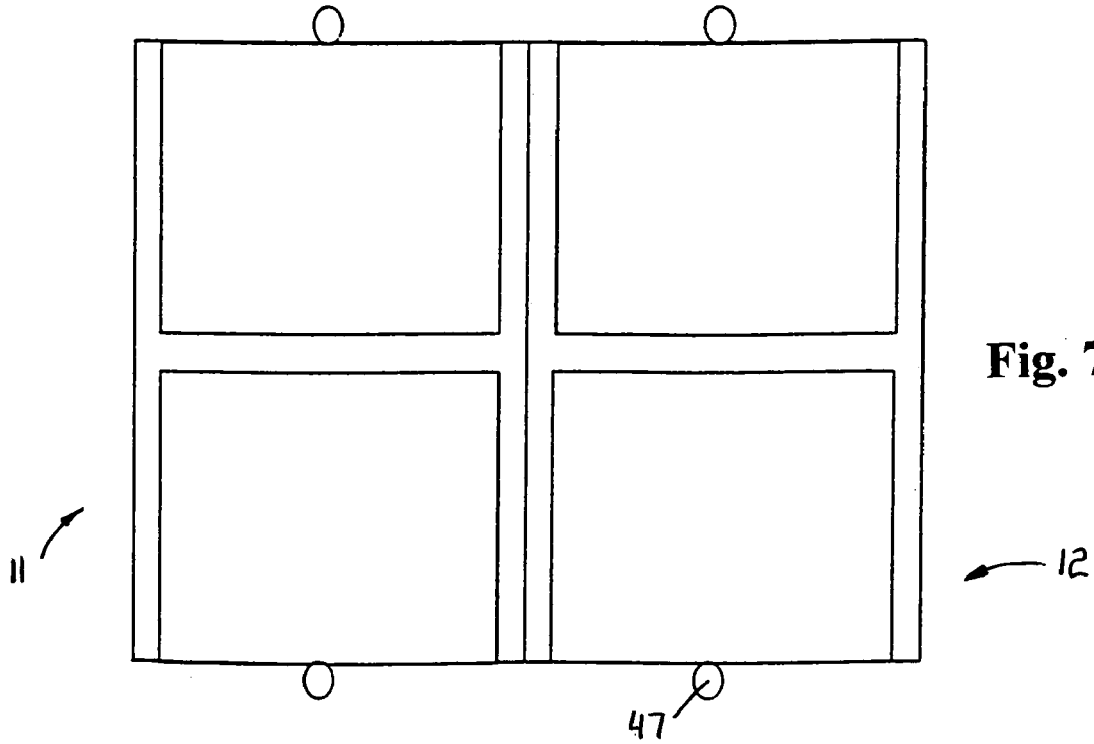
Figure 7F:
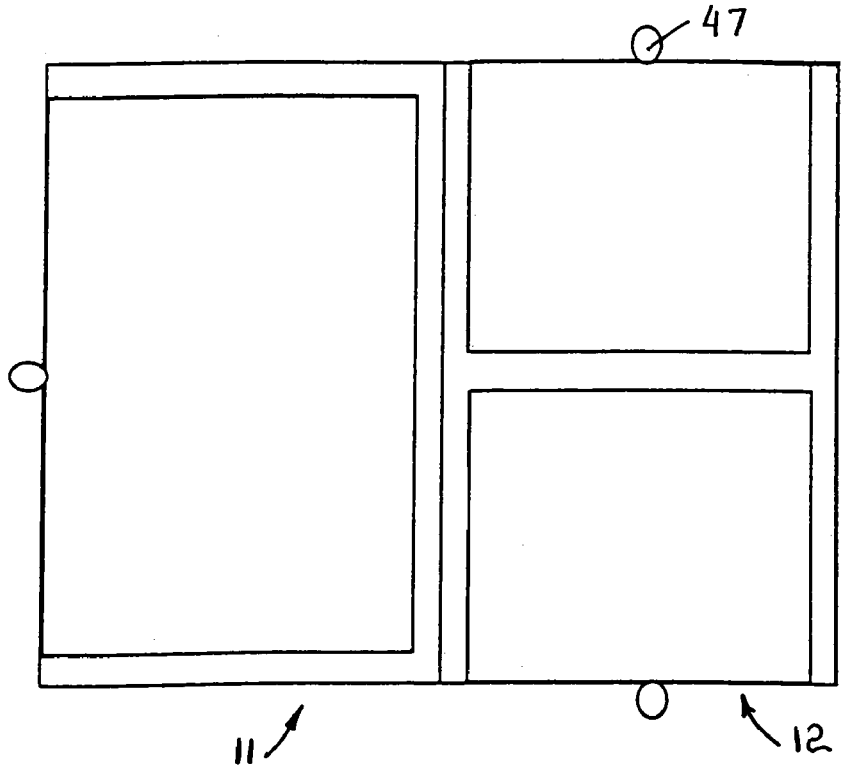

Referring to FIGS. 1*c*, 4*a*–6*b*, 6*e*, 7*b*–7*d* the closed (unfolded) game board 1, having the configuration of the box, provides an inside piece storage compartment 19 where the pieces 5, 6 can be stored. For example, the pieces 5, 6 can be placed in the bag(s)/not shown/ and stored in the storage compartment 19. The game board 1 can comprise the drawer(s) for storage of the pieces 5 and 6, as shown in FIGS. 6*a*–7*f* Referring to FIGS. 6*a*, 6*b*, the game board 1 comprises one drawer in each half of the board 1, for instance, the first drawer 20 with white pieces is for white piece player and another second drawer 21 with black pieces is for black piece player. In FIG. 6*c* is shown the example of the drawer (e.g. drawers 20, 21) without compartment wall 22, but the drawer(s) can include, for example, the compartment wall 22 (see FIG. 6*d*) to separate the drawer for two compartments: a first compartment 26 for the chess pieces 5 and a second compartment 27 for the checker/backgammon pieces 6. The first opening 23, second opening 24 and sliding means 25 are provided. The first 23 and second 24 openings are located in the appropriate halves 11, 12 of the game board 1. The game board 1 can comprise, for example, two drawers (see FIGS. 6*a*–6*e*, 7*a*–7*d*), each of which is located on the opposite sides of the board 1, four drawers, each pair of which is located on the opposite sides of the board 1, as shown in FIG. 7*e*, etc. The drawers and appropriate openings can be of any, size, form and configurations (e.g. the oval, trapezoidal form, etc), quantity and location (e.g. three drawers, as shown in FIG. 7*f*). The sliding means 25 can include the drawer corbel 34, which is slid into board wall slot 35 located into the board wall 38, as shown in FIG. 6*e*, or the sliding means 25 can include drawer outer wall slot 36 and the board corbel 37, as shown in FIGS. 6*a*, 6*c*. The sliding means 25 can be of any reasonable form, configuration and size, and in compliance with any reasonable principles for sliding mechanisms (e.g. the drawer wall corbel /not 34 sliding between two board wall corbels /not shown/, or roller principles, etc). Also, the drawer(s) can include the lid(s) 28, as shown in FIGS. 7*a*–7*d*. The drawer lid 28 is slid into the drawer inner wall slot 32 located on the inner side of the drawer wall 33, as shown, for example, in FIGS. 7*a*, 7*b*. The drawer(s) can include the drawer handle means 47, as shown in FIGS. 6*a*–6*d*, 7*c*–7*f*.

The board 1 includes the holes (apertures) 29 providing the central positioning of the piece on the squares 4 of the chess/checker field 2. The diameter "D" of the holes 29 in the squares 4 of the board 1 is slightly bigger than the diameter "d" of the director 31 of the pieces 5, 6 (D>d) in order to provide the passage of the director 31 (see FIG. 3*c*) into the apertures 29 (see FIGS. 5*d*, 8*a*). If the chess/checker game field pattern is not printed on the main layer 18, the same holes are appropriately can be provided into chess/checker game field layer 16. The holes 29 can have any reasonable length, for example, as shown in FIGS. 4*b*, 4*c*, 5*a*–6*b*, 6*e*.

The checker players can during the game use the checker/backgammon pieces 6 in the normal position (director 31 down) or upside-down (director 31 up). The piece's upside-down position also can be used for recognition of the "king" piece (in order to increase visual perception of the "king" piece, the director 31 of all pieces 6 can have a different bright color appropriately for white and black pieces).

Figure 3A:
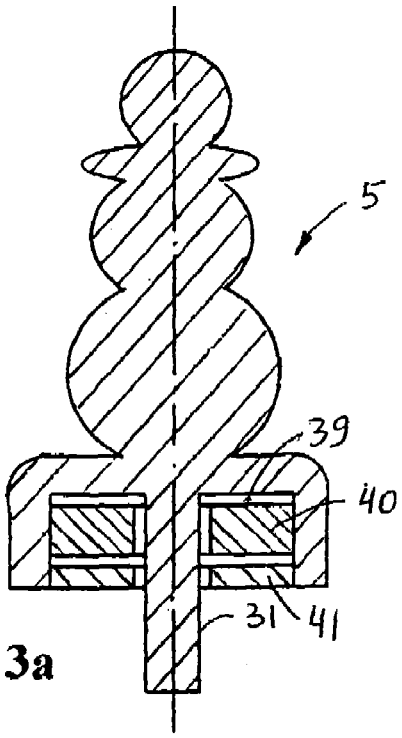
FIGS. 3*a*–3*f* are the simplified cross-sectional view of the pieces of the improved portable (pocket-size) multi-game apparatus.
Figure 3B:
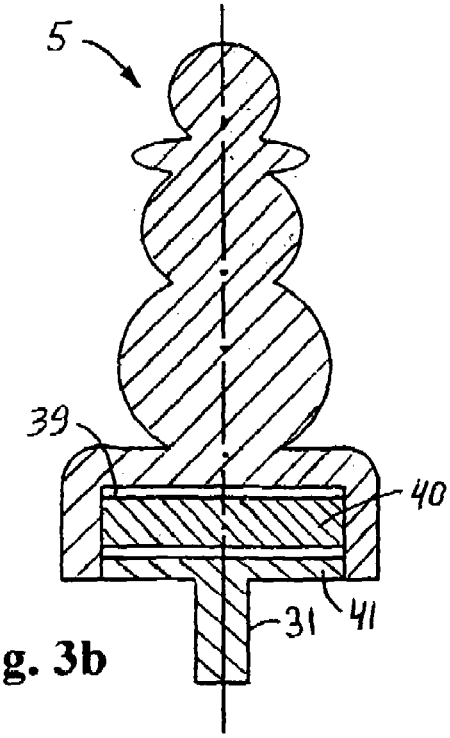
Figure 3C:
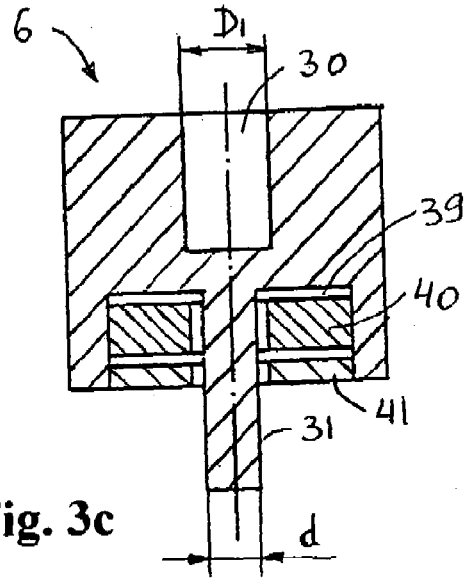
Figure 3D:
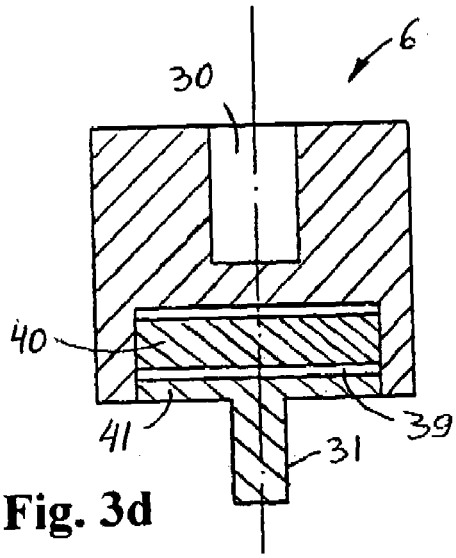
Figure 3E:
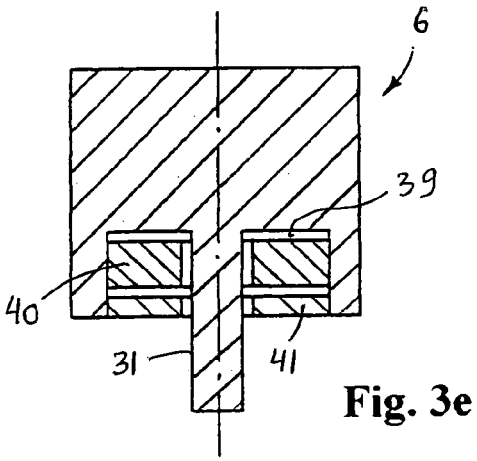
Figure 3F:
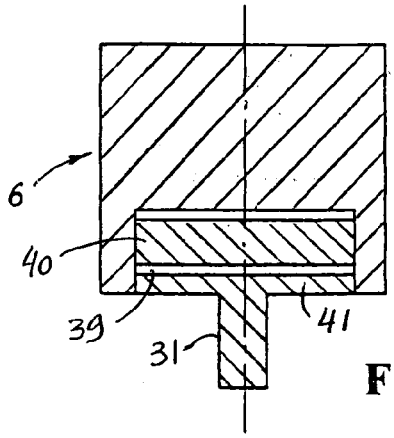

The backgammon players during the game use the checker/backgammon pieces 6 in the convenient upside-down position (director 31 up), but the triangular sections of the backgammon field layer 17 can include the apertures 29/not shown/ or the slot /not shown/ along the bisector of the triangular sections for the director 31 if the players use the pieces 6 in the normal position (director 31 down). The appropriate space into the inner side 43 of the board game 1; and if needed into main layer 18 located between the layer 17 and inner side 43 can be provided too. Each piece (chess piece 5 and checker/backgammon piece 6) can include the director 31 located in the piece opening 39, as shown in FIGS. 3*a*, 3*c*, 3*e*. Referring to FIGS. 3*a*, 3*c*, 3*e*, each piece includes the piece inclosure 40, which can be, for example, of a non-magnetic metallic material (e.g. a metallic washer), if the board 1 includes the main layer 18 which is of a magnetic material or includes the field layers 16 and/or 17 which are of a magnetic material. If the main layer 18 or field layers 16 and 17 are not of a magnetic material (e.g. of metallic material), the piece inclosure 40 is of a magnetic material. Also, each piece can include the piece opening caver 41, as shown in FIGS. 3*a*–3*f* Also, layer(s) or board and piece's inclosure 40 can be of magnetic material with the magnetic attraction effect. According to FIGS. 3*b*, 3*d*, 3*f* each piece can comprise a piece opening cover 41, which includes the director 31. Additionally, the checker piece 6 can include a recess hole 30 (see FIGS. 3*c*, 3*d*) in order to provide a recognition of the player's "king piece" by installing the second checker piece over (onto) the first checker piece (the director 31 of the second checker piece is inserted into recess hole 30 of the first checker piece). The diameter "$D_1$" of the recess hole 30 (see FIG. 3*c*) can for example be adequate to the diameter "D" of the aperture 29 in the squares 4 of the board 1 (e.g. $D_1$=D), and "$D_1$" is slightly bigger than the diameter "d" of the director 31 of the pieces 5, 6 ($D_1$>d) to provide the passage of the director 31 into the recess hole 30.

Figure 8A:
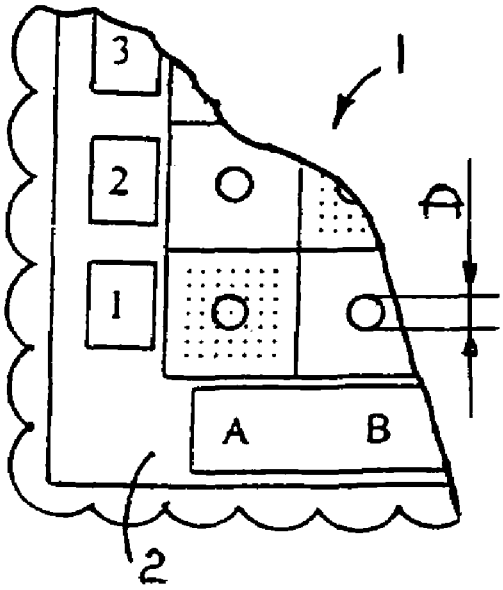
FIGS. 8*a*, 8*b* are the simplified representations of the board wall configuration.
Figure 8B:
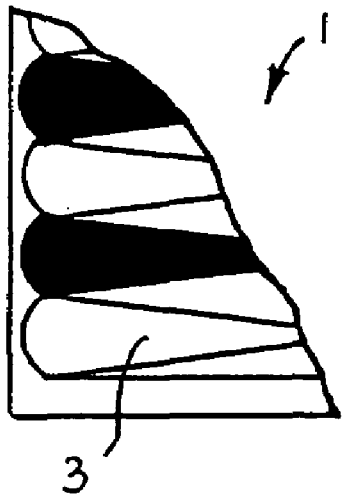

The game board, pieces, layers and the mentioned above means can have any reasonable form, configuration and size, and made of any reasonable and applicable material (e.g. such as wood, glass, plastic, metal, para-magnetic material, etc). For example, the outer side of the board wall 38 can have the shape, as shown in FIG. 8*a*, and the inner side of the board wall 38 can have the shape, as shown in FIG. 8*b*. The foldable para-magnetic material for the game board 1 can be used too. The game board 1 can include the locking means (not shown) to secure the board 1 closed (folded) position (e.g. shown in FIGS. 4*a*, 6*b*) and/or locking means (not shown) to secure the board 1 open (ready to play, unfolded) position (e.g. shown in FIGS. 1*a*, 2*a*). The game board 1 can be done of the magnetic material with the appropriately printed chess/checker game field and backgammon game field (not shown). In this case, the game board 1 includes the apertures 29, and does not need to include the layers 16, 17, 18.

CONCLUSION, RAMIFICATION AND SCOPE

Accordingly the reader will see that, according to the invention, I have provided a convenient portable board multi-game set. There has thus been outlined, rather broadly, the more important features of the invention. In this respect, it is understood that the invention is not limited in its application to the details of construction and to the arrangements of the components set forth in the description and/or drawings. The invention is capable of other embodiments and of being practiced and carried out in various ways. Also, it is to be understood that the phraseology and terminology employed herein are for the purpose of description and should not be regarded as limiting.

While the above description contains many specificities, these should not construed as limitations on the scope of the invention, but as exemplification of the presently-preferred embodiments thereof. Many other ramifications are possible within the teaching to the invention. For example, an improved portable board multi-game set can be successfully used by tourists and/or elderly people, having general physical limitations to carry regular size and heavy sets made of wooden material.

As such, those skilled in the art will appreciate that the conception, upon which this disclosure is based, may readily be utilized as a basis for the designing of other structures, for carrying out the several purpose of the present invention. It is important, therefore, that the claims be regarded as including such equivalent constructions insofar as they do not depart from the spirit and scope of the present invention.

THE DRAWING REFERENCE NUMERALS

1.—a game board;
2.—a chess/checker game field;
3.—a backgammon game field;
4.—a square;
5.—a chess piece;
6.—a checker/backgammon piece;
7.—a first numerical symbol field;

8.—a first alphabetical symbol field;
9.—a second numerical symbol field,
10.—a second alphabetical symbol field;
11.—a first half—board;
12.—a second half—board;
13.—a first hinging means;
14.—a second hinging means;
15.—a third hinging means;
16.—a chess/checker field layer;
17.—a backgammon field layer;
18.—a main layer;
19.—a piece storage compartment;
20.—a first drawer;
21.—a second drawer;
22.—a compartment wall;
23.—a first opening;
24.—a second opening;
25.—a sliding means;
26.—a first compartment for chess pieces;
27.—a second compartment for checker/backgammon pieces;
28.—a drawer lid;
29.—an aperture;
30.—a recess hole of the piece;
31.—a director;
32.—a drawer inner wall slot;
33.—a drawer wall;
34.—a drawer corbel;
35.—a board wall slot;
36.—a drawer outer wall slot;
37.—a board corbel;
38.—aboard wall;
39.—a piece opening;
40.—a piece inclosure;
41.—a piece opening cover;
42.—an outer side of the game board 1;
43.—an inner side of the game board 1;
44.—an inner side of the chess/checker field layer;
45.—an inner side of the backgammon field layer;
46.—a folding means;
47.—a drawer handle means;
48—48, 49—49, 50—50 and 51—51 are the cross—sectional views.

The invention claimed is:

1. A portable board multi-game set, comprising:

a game board including a first half-board and second half-board coupled by a folding means each half-board having recesses for installing layers in them;

a first chess/checker half-field layer and a second chess/checker half-field layer installed in the said recesses and attached by their inner side to an outer side of appropriate said first half-board and said second half-board, and wherein each of said first chess/checker half-field layer and said second chess/checkers field layer includes an appropriate chess/checker game half-field which is located on an outer side of said first chess/checker half-field layer and said second chess/checkers field layer, and wherein each of said chess/checker game half-field comprises an appropriate alphabetical symbol field, an appropriate first numerical symbol field, an appropriate second numerical symbol field and squares;

a first backgammon half-field layer and a second backgammon half-field layer attached by their inner side to an inner side of appropriate said first half-board and second half-board, and wherein each of said first backgammon half-field layer and said second backgammon half-field layer includes a backgammon game half-field which is located on an outer side of said first backgammon half-field layer and said second backgammon half-field layer;

a piece set, each piece of which includes an opening, an inclosure and a director, and wherein said inclosure is installed in said opening;

an aperture located in a center of each square of said squares, and wherein an inside diameter of said aperture is slightly bigger than an outside diameter of said director provides to provide a passage of said director.

2. The device of claim 1, wherein said first chess/checker half-field layer and said second chess/checker half-field layer are of a magnetic material, and said inclosure is of magnetic material, or said first chess/checker half-field layer and said second chess/checker half-field layer are of a magnetic material, and said inclosure is of metallic material, or said first chess/checker half-field layer and said second chess/checker half-field layer are of metallic material, and said inclosure is of magnetic material.

3. The device of claim 1, wherein said a first backgammon half-field layer and a second backgammon half-field layer are of a magnetic material, and said inclosure is of magnetic material, or said a first backgammon half-field layer and a second backgammon half-field layer are of a magnetic material, and said inclosure is of metallic material, or said a first backgammon half-field layer and a second backgammon half-field layer are of a metallic material, and said inclosure is of magnetic material.

4. The device of claim 1, wherein further said inner side of said first chess/checker half-field layer and said second chess/checker half-field layer is self-adhesive.

5. The device of claim 1, wherein further said inner side of said first backgammon half-field layer and said second backgammon half-field layer is self-adhesive.

6. The device of claim 1, wherein said game board comprises a side wall on each side of said game board, and wherein said game board in the folded position forms a compartment for a storage of the pieces.

7. The device of claim 6, wherein furthers at least one of the side walls of said game board comprises an opening for an appropriate drawer which provides said storage of the pieces.

8. A portable board multi-game set, comprising:

a game board including a first half-board and second half-board coupled by a folding means each half-board having recesses for installing layers in them;

a first main half-layer and a second main half-layer installed in said recesses and which are of magnetic material and are by their inner side attached to an outer side of appropriate said first half-board and second half-board;

a first chess/checker half-field layer and a second chess/checker half-field layer which are by their inner side attached to an appropriate outer side of said first main half-layer and said second main half-layer, and wherein each of said first chess/checker half-field layer and said second chess/checkers field layer includes an appropriate chess/checker game half-field which is located on an outer side of said first chess/checker half-field layer and said second chess/checkers field layer, and wherein each of said chess/checker game half-field comprises an appropriate alphabetical symbol field, an appropriate first numerical symbol field, an appropriate second numerical symbol field, and squares;

a first backgammon half-field layer and a second backgammon half-field layer attached by their inner side to an inner side of appropriate said first half-board and second half-board, and wherein each of said first backgammon half-field layer and said second backgammon half-field layer includes a backgammon game half-field which is located on an outer side of said first backgammon half-field layer and said second backgammon half-field layer;

a piece set, each piece of which includes an opening, an inclosure of a magnetic material and a director, and wherein said inclosure is installed in said opening;

an aperture located in a center of each square of said squares, and wherein an inside diameter of said aperture is slightly bigger than an outside diameter of said director provides to provide a passage of said director.

9. The device of claim 8, wherein further said first chess/checker half-field layer and said second chess/checker half-field layer are by their inner side attached to said outer side of appropriate said first half-board and said second half-board, said first main half-layer and said second main half-layer are by their inner side attached to said inner side of appropriate said first half-board and second half-board, and wherein said first backgammon half-field layer and said second backgammon half-field layer are by their inner side attached to said outer side of said first main half-layer and said second main half-layer.

10. The device of claim 8, wherein further said first main half-field layer and said second main half-field layer are of metallic material and said inclosure is of magnetic material, or said inclosure is of metallic material and said first main half-field layer and said second main half-field layer are of magnetic material.

11. The device of claim 8, wherein further at least said inner side of said first main half-field layer and said second main half-field layer is self-adhesive.

12. The device of claim 8, wherein further said inner side of said first chess/checker half-field layer and said second chess/checker half-field layer is self-adhesive.

13. The device of claim 8, wherein further said inner side of said first backgammon half-field layer and said second backgammon half-field layer is self-adhesive.

14. The device of claim 8, wherein said game board comprises a side wall on each side of said game board, and wherein said game board in the folded position forms a compartment for a storage of the pieces.

15. The device of claim 14, wherein furthers at least one of the side walls of said game board comprises an opening for an appropriate drawer which provides said storage of the pieces.

* * * * *